US006062677A

United States Patent [19]

Satoh

[11] Patent Number: 6,062,677

[45] Date of Patent: May 16, 2000

[54] TONER THAT INCLUDES CORE MATERIAL AND FINE-POWDERED ABRASIVE FOR USE IN IMAGE-FORMING APPARATUS

[75] Inventor: Noriaki Satoh, Nagoya, Japan

[73] Assignee: Brother Kogyo Kabushiki Kaisha, Nagoya, Japan

[21] Appl. No.: 08/934,752

[22] Filed: Sep. 22, 1997

[30] Foreign Application Priority Data

Sep. 24, 1996 [JP] Japan ..... 8-251261

[51] Int. Cl.[7] ..... B41J 2/04

[52] U.S. Cl. ..... 347/55

[58] Field of Search ..... 347/55, 95, 100; 430/45, 47, 120, 124, 126; 427/474, 203, 366; 399/258, 259, 60

[56] References Cited

U.S. PATENT DOCUMENTS

| | | | |
|---|---|---|---|
| 3,689,935 | 9/1972 | Pressman et al. . | |
| 4,743,926 | 5/1988 | Schmidlin et al. . | |
| 4,755,837 | 7/1988 | Schmidlin et al. . | |
| 4,780,733 | 10/1988 | Schmidlin . | |
| 4,814,796 | 3/1989 | Schmidlin . | |
| 4,912,489 | 3/1990 | Schmidlin . | |
| 5,036,341 | 7/1991 | Larsson . | |
| 5,552,814 | 9/1996 | Maeda et al. . | |
| 5,781,217 | 7/1998 | Desie | 347/55 |
| 5,824,442 | 10/1998 | Tanikawa et al. | 430/45 |

FOREIGN PATENT DOCUMENTS

| | | |
|---|---|---|
| 6-155798 | 6/1994 | Japan . |

*Primary Examiner*—John Barlow
*Assistant Examiner*—Raquel Yvette Gordon
*Attorney, Agent, or Firm*—Oliff & Berridge, PLC

[57] ABSTRACT

In a toner for an image-forming apparatus having a toner flow control means for controlling the flow of a charged toner and a toner feeding means for feeding the charged toner to the toner flow control means, the toner feeding means and the toner flow control means being so provided as to come into contact with each other through the charged toner, the toner comprises a core material constituted of at least a binder resin, and a fine-powdered abrasive adhering to the surface of the core material.

10 Claims, 4 Drawing Sheets

TONER THAT INCLUDES CORE MATERIAL AND FINE-POWDERED ABRASIVE FOR USE IN IMAGE-FORMING APPARATUS

BACKGROUND OF THE INVENTION

1. Field of the Invention

This invention relates to a toner for an image-forming apparatus usable in copying machines, printers, plotters, facsimile machines and so forth.

2. Description of the Related Art

As one of conventional image-forming apparatus, for example, U.S. Pat. No. 3,689,935 discloses an apparatus in which, using an electrode member with a plurality of openings (hereinafter "apertures") formed therein, the pass of toner particles through the apertures is controlled in accordance with image data so that an image is formed on a recording medium by the use of the toner particles having passed through them.

Stated specifically, this image-forming apparatus comprises:

- an aperture electrode member constituted of a thin flat sheet formed of an insulating material, a reference electrode continuously formed on one side of the flat sheet, a plurality of control electrodes insulated from one another, formed on the other side of the flat sheet, and a plurality of apertures which are so formed as to run through the flat sheet, the reference electrode and the control electrode for each control electrode and are arranged at least in a row;
- a means for selectively providing between the reference electrode and the control electrode a potential difference in accordance with image data;
- a means for feeding electrostatically charged particles toward the apertures in such a manner that the pass of the particles through the apertures is controlled according to the potential difference; and
- a means for positionally adjusting (or registering) a recording medium in the flow path of the toner particles so that the recording medium and the aperture electrode member can move in a relative fashion.

U.S. Pat. No. 4,743,926, U.S. Pat. No. 4,755,837, U.S. Pat. No. 4,780,733 and U.S. Pat. No. 4,814,796 also disclose an image-forming apparatus in which such an aperture electrode member is so provided that its control electrodes face a recording medium side and its reference electrode faces a toner feeding side.

In contrast, U.S. Pat. No. 4,912,489 disclose an image-forming apparatus in which such an aperture electrode member is so provided that its reference electrode faces a recording medium side and its control electrodes face a toner feeding side so that the voltage applied to the control electrodes can be made lower by about ¼ than the image-forming apparatus disclosed in the above U.S. Patents.

Here, the time at which the toner is not allowed to pass through the apertures so that the toner particles are not made to adhere onto the recording medium, i.e., the point of time at which white background areas of an image are formed thereon is hereinafter called "off-time", and the reverse instance, i.e., the point of time at which the toner is allowed to pass through the apertures so that dots are formed by the toner on the recording medium is hereinafter called "on-time".

The voltage applied to the control electrodes is also hereinafter called "control voltage". Thus, "control voltage at the on-time" is meant to be a voltage applied to the control electrodes in order to form the toner dots on the recording medium by allowing the toner particles to adhere onto the recording medium. In reverse, "control voltage at the off-time" is meant to be a voltage applied to the control electrodes in order to form a white background of an image on the recording medium by allowing the toner not to pass through the apertures. The difference in voltage between the control voltage at the on-time and the control voltage at the off-time is called "drive voltage". Also, an aggregate of the toner dots disposed at any desired position on the recording medium by using the image-forming apparatus constituted as described above is called "toner image". Thus, the toner image is meant to be an image formed by selectively arranging the toner dots on the white background that is a ground of the recording medium. Arrangement of dot areas and white background areas is regarded as the toner image.

In the conventional image-forming apparatus as described above, however, the control electrodes are driven by circuit devices such as ICs and hence the drive voltage may preferably be set as low as possible. In order to use practical and inexpensive ICs, the control voltage must be set within 50 V, whereas the relationship between control voltage and image density (hereinafter "control voltage characteristics") stands as shown by a broken-line curve in FIG. 5A. Accordingly, whatever control voltages are set at the on-time and at the off-time within the range where the control voltage of 50 V is maintained, it has been substantially impossible to attain image-forming conditions under which a sufficient density of 1.5 or above as a value of reflection density at the on-time and a good white background free of fog, having a reflection density of 0.07 or below, at the off-time can be achieved at the same time.

The control voltage characteristics shown in FIGS. 5A and 5B are as obtained in an instance where a negatively chargeable toner is used as the toner.

Stated specifically, in the control voltage characteristics shown in FIG. 5A, the slope on the high-voltage side is steep and on the other hand the slope on the low-voltage side is gentle. Hence, a voltage of +65 V or above is necessary in order to attain the density required at the on-time and, taking account of safety factors, a control voltage of about +70 V must be actually applied. Assuming this voltage as a standard and in an instance where the control voltage is made lower than this voltage, the off-state is not attained even if the control voltage is made lower by 50 V than that at the on-time so as to be +20 V, because the slope of the control voltage characteristics on the low-voltage side is gentle. In order to surely provide the off-state, the control voltage must be made lower than −20 V, so that the drive voltage reaches 90 V.

Incidentally, ideal control voltage characteristics are as shown by a solid line in FIG. 5B, where the density can be binarily controlled at a certain voltage threshold value. Under such conditions, the drive voltage can be made very low. It, however, actually stands as shown by the broken line in FIG. 5A. The greatest reason therefor is that the toner fed to a toner flow control means varies in charge quantity.

More specifically, the electrostatic force acting on the toner differs as a matter of course when the charge quantity differs. Hence, when the control voltage characteristics are set as shown in FIG. 5B in respect of a toner having a charge quantity in a certain narrow range, the voltage threshold value differs as a matter of course in respect of a toner having a charge quantity different from that, so that a value shifted in parallel in the lateral direction in FIG. 5B is obtained. Thus, a toner having a charge quantity distribution has such control voltage characteristics that the curve of FIG. 5B concerning the different charge quantity is overlapped with the charge quantity distribution, and consequently, has the characteristics as shown by the broken line in FIG. 5A.

The charge quantity distribution of such a toner is partly ascribable to the distribution of particle size, but the greatest reason therefor is that the toner is not uniformly saturation-charged. More specifically, the reason is that the toner has a broad distribution in type including a toner well saturation-charged and even a toner almost not charged. Hence, it is most preferable for the toner to be uniformly saturation-charged. For this end, the toner may be triboelectrically charged for a longer time so that the toner can have more opportunities for triboelectric charging.

However, in the conventional image-forming apparatus, the charging of toner by a toner feeding means is commonly carried out by bringing the toner into friction between a toner carrying member and a toner feeding means which are constituents of the toner feeding means, and between the toner carrying member and a toner layer control blade. Since, however, no satisfactory results have been obtained by only these means, the present applicant has proposed in Japanese Patent Application Laid-open No. 6-155798 an image-forming apparatus so constructed that, in addition to these means, the toner carrying member is pressed against the electrode member in its vicinity where the apertures are formed.

In this image-forming apparatus, the toner can be triboelectrically charged also between the apertures and the toner carrying member, and hence the charging of the toner reaches a saturation value. Moreover, because of slidable movement imparted to the toner at the time of this charging, the toner tumbles on the surface of the toner carrying member, so that the attractive force due to the electrostatic image force and so forth acting between the toner and the surface of the toner carrying member is weakened and the ejection of toner from the apertures at the on-time is promoted. Furthermore, the distance between the surface of the toner carrying member and the control electrodes of the electrode member, which provides the part where the toner is fed to the apertures, become close to the extent of the particle size of the toner, so that the effect of preventing the toner flow from passing through the apertures at the off-time can be improved to bring about the effect of making the control voltage lower.

However, this image-forming apparatus has had the following problems: The pressure acting between the electrode member and the toner carrying member brings about an increase in stress such as shear force applied to the toner, which may cause the toner to thermally melt-adhere to the electrode member with lapse of time of image formation on a few sheets to tens of sheets of A4-size paper, and the resultant molten deposit may obstruct the feeding of toner to apertures, resulting in a decrease in density of images formed, or in a worst case, making it impossible to form images.

SUMMARY OF THE INVENTION

The present invention was made in order to solve the problems discussed above. Accordingly, an object of the present invention is to provide a toner that can prevent itself from melt-adhering to the electrode member, can be uniformly saturation-charged in a short time and can stably form good images over a long period of time.

To achieve this object, the present invention provides a toner which is used in an image-forming apparatus having a toner flow control means for controlling the flow of a charged toner and a toner feeding means for feeding the charged toner to the toner flow control means, the toner feeding means and the toner flow control means being so provided as to come into contact with each other through the charged toner, wherein the toner comprises a core material constituted of at least a binder resin, and a fine-powdered abrasive adhering to the surface of the core material.

This and other objects, features and advantages of the present invention are described in or will become apparent from the following detailed description of the invention.

DETAILED DESCRIPTION OF THE INVENTION

Figure 1:
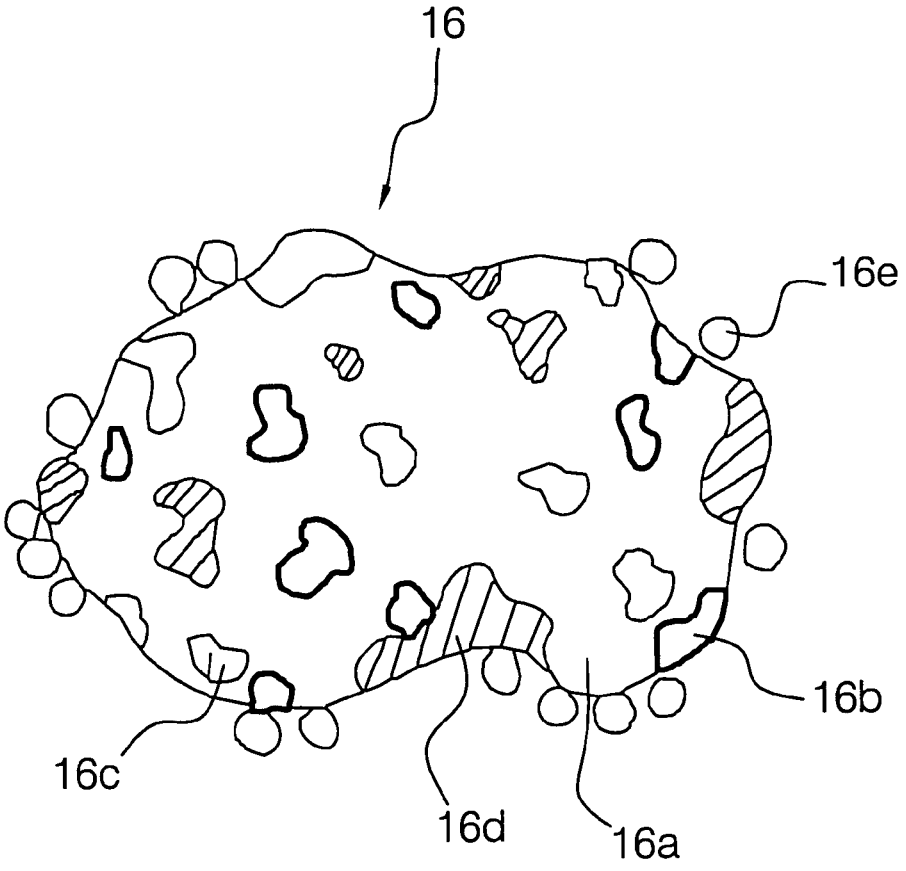
FIG. 1 is an enlarged view schematically showing the form of a toner (a toner particle) according to an embodiment of the present invention.

The toner of the present invention is a toner which is used in an image-forming apparatus having a toner flow control means for controlling the flow of a charged toner and a toner feeding means for feeding the charged toner to the toner flow control means, the toner feeding means and the toner flow control means being so provided as to come into contact with each other through the charged toner, and which is characterized by having a core material constituted of at least a binder resin, and a fine-powdered abrasive adhering to the surface of the core material. The use of the abrasive in this way allows the toner to melt-adhere to the toner flow control means with difficulty and also, even when the toner is about to melt-adhere, brings about the effect of taking off such toner. Hence, the toner is free from melt-adhering to the toner flow control means and also can be uniformly saturation-charged in a short time, so that the image-forming apparatus can be stably driven.

Such an abrasive may preferably include aluminum oxide and titanium oxide, having a high hardness. The use of such a high-hardness abrasive enables more effective removal of toner even when the toner is about to melt-adhere to the toner flow control means. Hence, it becomes possible to provide a toner that does neither melt-adhere nor become deposited to the toner flow control means.

The abrasive may preferably have a particle diameter of from 0.0001 to 1 $\mu$m, and more preferably from 0.001 to 0.1 $\mu$m, because the production of an abrasive having a too small particle diameter is very difficult and the use of an abrasive having a too large particle diameter may cause an image quality to lower because of its low fluidity.

The abrasive may be used in an amount of from about 0.01 to about 3 parts by weight, more preferably from about 0.1 to about 1 part by weight, and particularly preferably about 1 part by weight based on 100 parts by weight of the binder resin. Its use in either a too large quantity or a too small quantity may bring about the desired effect with difficulty.

As the binder resin that constitutes the core material of the toner, those conventionally used as binder resins for toners may be used. For example, a styrene-acrylic resin, a polyester resin, a melamine resin, a phenol resin or a nylon resin may be used preferably.

The core material of the toner particles may be further optionally incorporated with known additives as exemplified by a colorant (such as carbon black), a release agent (such as wax) and a charge control agent.

The core material of the toner may preferably have a particle diameter of from 5 to 20 $\mu$m, and more preferably from 6 to 12 $\mu$m, because the production of a core material having a too small particle diameter is very difficult and the one having a too large particle diameter may cause the reproducibility for fine lines to lower.

The toner of the present invention can be produced by mixing the binder resin with the colorant, the release agent, the charge control agent and so forth, making the mixture into particles to prepare the core material, and allowing the fine-powered abrasive and optionally other additives such as a fluidity-providing agent to adhere to the surface of the resultant core material.

The image-forming apparatus using the toner of the present invention has a toner flow control means for controlling the flow of a charged toner and a toner feeding means for feeding the charged toner to the toner flow control means, and the toner feeding means and the toner flow control means are so provided as to come into contact with each other through the charged toner. The apparatus is characterized by using as a toner the toner comprising the core material constituted of at least the binder resin and to which a fine powder of the abrasive has been externally added. Hence, when images are formed, the toner causes no melt-adhesion on the toner flow control means and a toner having a uniform charge quantity can be stably fed to the toner flow control means. Thus, good images can be stably formed over a long period of time.

In the image-forming apparatus, the use of the high-hardness aluminum oxide or titanium oxide enables more effective removal of toner even when the toner is about to melt-adhere to the toner flow control means. Hence, the toner neither melt-adheres nor becomes deposited to the toner flow control means, and the feeding of toner is not obstructed because any temporary deposition of toner does not occur on the toner flow control means.

In the image-forming apparatus, a toner in which the abrasive is used in an amount of from 0.01 to 3% by weight, more preferably from 0.1 to 1% by weight, and particularly preferably about 1% by weight based on the 100 parts by weight of the binder resin may be used as the toner, whereby the melt-adhesion of toner can be prevented and also the fog-free white background at the off-time and a sufficiently high density at the on-time can be attained. Thus, images can be stably formed and also images with a good contrast can be formed.

An embodiment of the image-forming apparatus using the toner of the present invention will be described below with reference to the accompanying drawings.

FIG. 1 is an enlarged view schematically showing the form of a toner 16 (a toner particle) according to an embodiment of the present invention.

The toner 16 is constituted of a binder resin 16*a*, a colorant 16*b*, a wax 16*c* as the release agent, a charge control agent 16*d* and an abrasive 16*e* which is a fine powder of aluminum oxide. It is produced by a process comprising first mixing the binder resin 16*a* with the colorant 16*b*, the wax 16*c* and the charge control agent 16*d*, followed by kneading, cooling, pulverization and classification to produce the core material as a powder showing a negative chargeability, and next allowing the fine-powered abrasive 16*e* to adhere to the surface of the core material in an amount of about 0.01 to about 3 parts by weight, more preferably about 0.1 to about 1 part and particularly u preferably about 1% by weight, based on 100 parts by weight of the binder resin.

Here, as a specific example of the core material composition, 100 parts by weight of a binder resin (polyester available from Mitsubishi Rayon Co., Ltd.), 13 parts by weight of a colorant (carbon black available from Mitsubishi Chemical Industries Limited), and 5 parts by weight of wax (polypropylene available from Sanyo Chemical Co., Ltd.) and 2 parts by weight of a charge control agent (a metal-containing dye available from Orient Chemical Industries Ltd.) were mixed, and the mixture was kneaded using a continuous type single-screw extruder. The kneaded product was cooled, followed by pulverization and classification to produce a negatively chargeable black core material having an average particle diameter of 9 $\mu$m. This was designated as Toner A.

To the surface of this Toner A, an aluminum oxide fine powder available from Fujimi Chemical Co. was allowed to adhere in the following amounts (parts by weight based on 100 parts by weight of the binder resin) shown in Table 1 to produce the eleven kinds of Toner B to Toner L.

TABLE 1

| Amount of $Al_2O_3$ | Toner |
|---|---|
| 0.001 | B |
| 0.005 | C |
| 0.01 | D |
| 0.05 | E |
| 0.1 | F |
| 0.5 | G |
| 1 | H |
| 3 | I |
| 5 | J |
| 7 | K |
| 10 | L |

Figure 2:
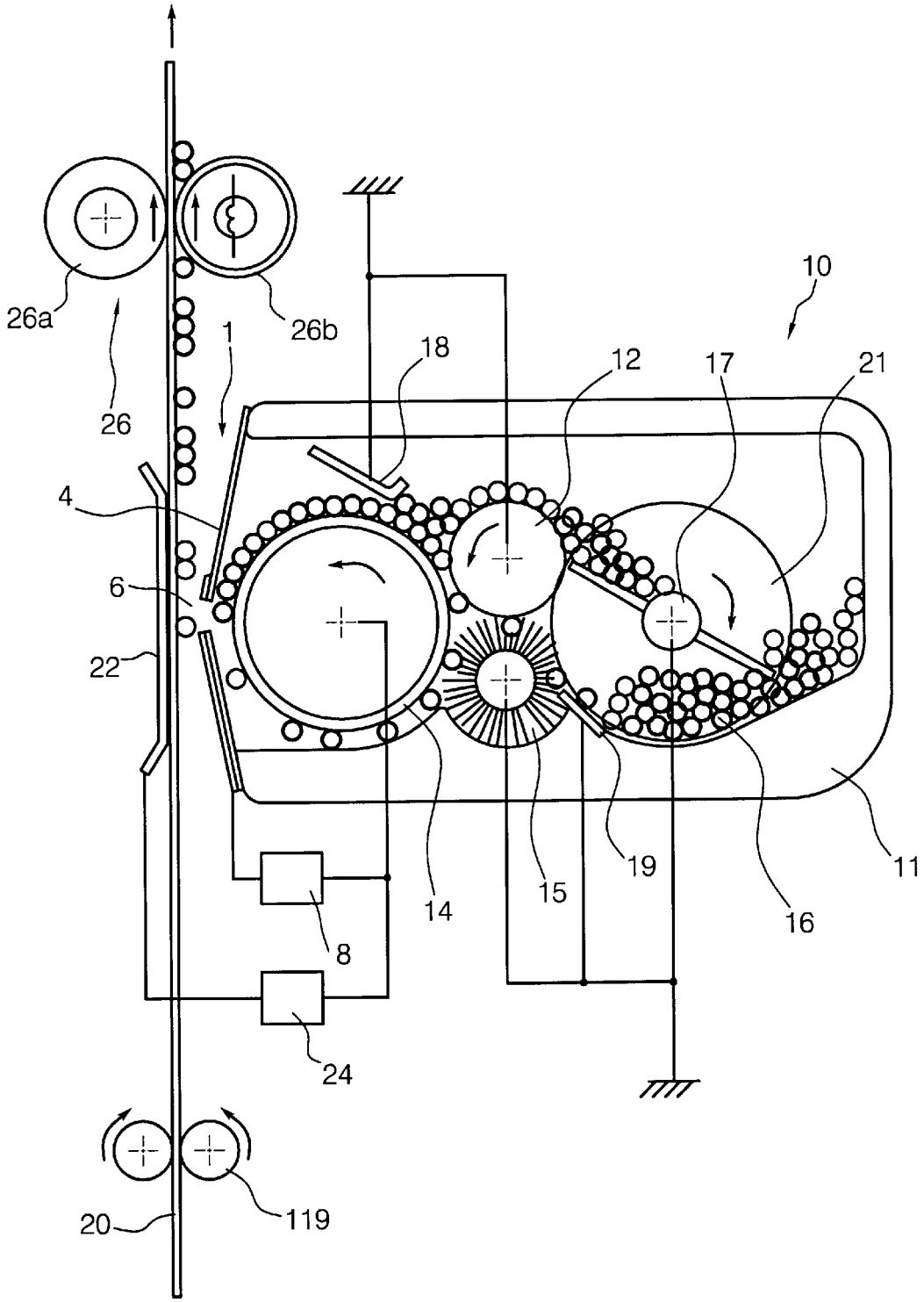
FIG. 2 schematically illustrates the constitution of an image-forming apparatus making use of the toner.

The above twelve sample Toners A to L of negatively chargeable toners were used in the image-forming apparatus shown in FIG. 2 to actually form images, and their output results were evaluated.

The outline of the image-forming apparatus will be frist described with reference to FIG. 2.

This image-forming apparatus for performing recording on a recording medium 20 such as recording paper is constituted of an aperture electrode member serving as the toner flow control means, a toner feeding assembly 10 serving as the toner feeding means, a back electrode for electrostatically attracting the toner 16 to the recording medium 20 and a fixing assembly 26 for heat-fixing the toner 16 having adhered to the recording medium 20.

On the left side of the aperture electrode member 1 in FIG. 2, the back electrode 22 is so provided on a chassis (not shown) as to leave a gap of about 1 mm. At the lower part of the back electrode 22, a pair of transport rollers 119 are provided, which are driven in the manner that the recording medium 20 can be inserted through the gap of about 1 mm. The toner feeding assembly 10 is provided on the right side of the aperture electrode member 1 in FIG. 2, and the fixing assembly 26 is provided ahead the transport direction of the recording medium 20 moved along the aperture electrode member 1.

The above respective constituents will be detailed below.

The toner feeding assembly 10 is constituted of a toner case 11 serving also as a housing of the assembly, in which the toner 16 is held in a toner receptacle 21 forming a space in the toner case 11, an agitator 17 for agitating the toner 16 held in the toner receptacle 21, a carrying roller 14 which is the toner carrying member for feeding the toner 16 toward the aperture electrode member 1, a feed roller 12 for feeding the toner to the surface of the carrying roller 14 while rubbing the former against the latter to triboelectrically charge the former, a toner layer control blade 18 for optionally further triboelectrically charging the toner 16 while uniformly leveling the quantity of the toner 16 on the carrying roller 14, the toner being carried on the carrying roller 14 while being negatively triboelectrically charged between the feeding roller 12 and the carrying roller 14, a collecting roller 15 for cleaning the surface of the carrying roller 14 having passed through the aperture electrode member 1, and a collecting blade 19.

As the carrying roller 14, for example, a roller member may be used which has a shaft made of metal on the periphery of which a surface layer formed of a semiconductive synthetic resin or rubber is provided. A roller entirely made of metal may also be used.

As the feeding roller 12, for example, a roller member may be used which has a shaft made of metal on the periphery of which a foamed spongy layer formed of a semiconductive material having a volume resistance is provided. Such a semiconductive sponge roller thus constituted may be replaced with a semiconductive rubber roller.

As the toner layer control blade 18, a plate-like member constituted of a metal or a synthetic resin may be used.

The feeding roller 12, the carrying roller 14 and the toner layer control blade 18 may be made of materials appropriately selected according to the composition of the toner 16 so that the toner 16 can have a predetermined charge polarity and charge quantity. The chargeability of the toner 16 can also be changed by compositional change of the toner 16 itself.

Here, the feeding roller 12, the carrying roller 14, the collecting roller 15 and the agitator 17 are supported on the toner case 11 in a state rotatable in the direction of each arrow shown in FIG. 2, which are provided in parallel one another. The carrying roller 14 and the feeding roller 12 are provided in contact with each other, and also the carrying roller 14 and the collecting roller 15 are done. The toner layer control blade 18 is adjusted in its positional relation to the carrying roller 14 so that the quantity of the toner 16 on the carrying roller 14 can be made constant at the desired quantity. The collecting blade 19 is so provided as to come in touch with the brush top of the collecting rollers 17, and is so constructed that the toner 16 adhering to the brush is scraped off into the toner receptacle 21 as the collecting rollers 17 is rotated.

Figure 3:
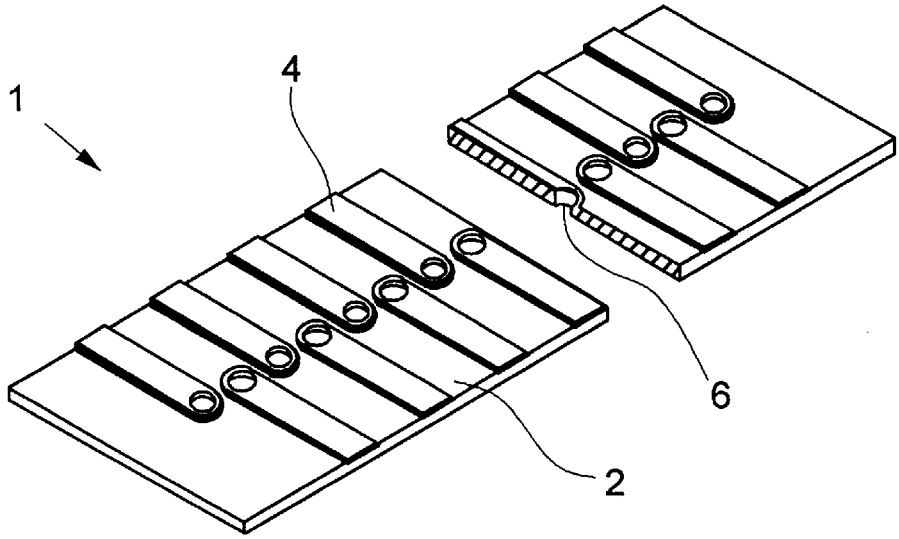
FIG. 3 is a perspective view schematically showing the constitution of an aperture electrode member used in the image-forming apparatus.

The aperture electrode member 1 comprises, as shown in FIG. 3, an insulating sheet of about 25 $\mu$m thick made of polyimide, a plurality of apertures 6 of about 100 $\mu$m diameter formed thereon and arranged in a row, and a control electrode 4 of 1 $\mu$m thick formed for each aperture 6. Then, the aperture electrode member 1 is, as shown in FIG. 2, so provided as to be brought into pressure contact with the carrying roller 14 at the position near to the apertures 6, in such a state that the control electrodes 4 face the recording medium 20 side.

Figure 4:
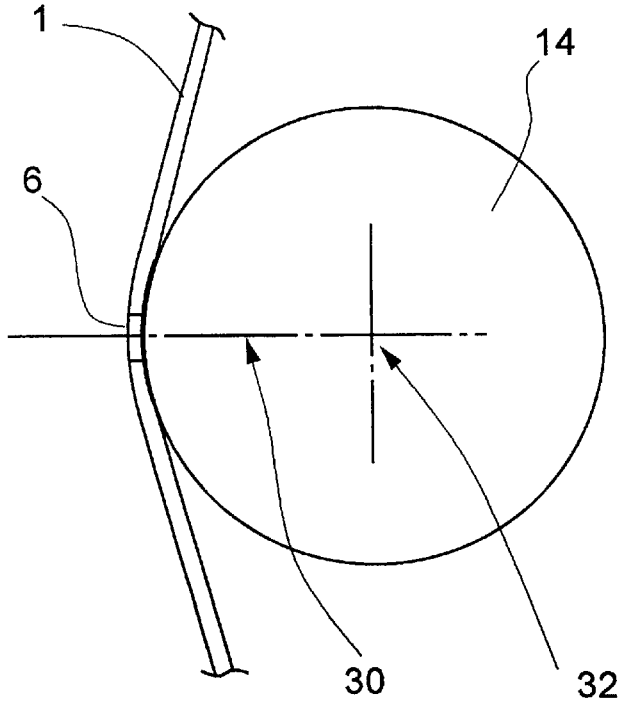
FIG. 4 diagrammatically illustrates the positional relationship between the aperture electrode member and a toner carrying roller in the image-forming apparatus.

The positional relationship between the apertures 6 of the aperture electrode member 1 and the carrying roller 14 will be detailed here. As shown in FIG. 4, the apertures 6 are so provided that their center lines 30 pass through the left-most end in FIG. 4, of the periphery of the carrying roller 14, and the axis 32 of the carrying roller 14. According to this construction, the apertures 6 can each be provided up and down equally on the basis of the left-most end of the periphery of the carrying roller 14, and the distribution of the toner passing through each aperture 6 can be made uniform through the whole area in the aperture 6. More specifically, for each aperture 6, there is no such a state that the toner 16 is fed in a large quantity to some one part (e.g., an upper or lower part) and almost no toner 16 is fed to the other part. Also , since the wall surfaces of the apertures 6 are in parallel to the direction in which the toner 16 fly, the wall surfaces can not be obstacles to the flying of the toner 16, and th e toner 16 can be made to always stably fly.

In addition, the aperture elect rod e member 1 itself is, as shown in FIG. 4, brought into pressure contact with the carrying roller 14 in such a way that it bends at the same angles up and down around the apertures 6. Hence, the area of contact of the aperture electrode member 1 with the carrying roller 14 can be made larger and also the apertures 6 can be brought into up and down uniform pressure contact at its end portions. Thus, the toner can have more opportunities for triboelectric charging, the toner 16 can be saturation-charged in a short time, and also the aperture electrode member 1 does not wrinkle, making it possible to prevent any non-uniform density from occurring when images are formed.

The shaft of the carrying roller 14, made of metal, is grounded. Control voltage application circuits e for applying voltage to the control electrodes 4 in accordance with image data are connected to the control electrodes 4. The control voltage application circuits 8 are those for applying control voltages of, e.g., 0 V at the off-time and +50 V at the on-time. Accordingly, a potential difference of 0 V or +50 V is produced between the carrying roller 14 and the control electrodes 4.

A DC power source 24 is further connected to the back electrode 22. This DC power source 24 is so set up that a voltage of about +1 kV can be applied to the back electrode 22.

How the image-forming apparatus constituted as described above operates will be further described below.

First, as the agitator 17 and the feeding roller 12 are rotated in the direction of the arrows shown in FIG. 2, the toner 16 held in the toner receptacle 21 adheres to the surface of the feeding roller 12. The toner 16 is negatively triboelectrically charged as a result of its friction with the carrying roller 14, and is carried on the carrying roller 14. The toner 16 carried thereon is formed into a uniform thin layer by the toner layer control blade 18 and, as the carrying roller 14 is rotated, transported toward the aperture electrode member 1. Then, the toner 16 carried on carrying roller 14 is fed to the position of the apertures 6 while being rubbed with the insulating sheet 2 of the aperture electrode member 1.

Here, the control voltage of +50 V at the on-time or the control voltage of 0 V at the off-time is applied from the control voltage application circuits 8 to the control electrodes 4 in accordance with image data.

Upon application of the voltage of +50 V to the control electrodes 4, the potential difference produced between the control electrodes 4 and the carrying roller 14 form electric fields in the vicinity of the corresponding apertures 6. The negatively charged toner undergoes an electrostatic force in the direction of a higher potential, and hence is released from the surface of the carrying roller 14 to fly to the side of the control electrodes 4 and pass through the apertures 6. The toner 16 having passed through them is, by the aid of an electric field formed between the recording medium 20 and the aperture electrode member 1 by the voltage applied to the back electrode 22, further caused to fly to the recording medium 20, and is accumulated on the recording medium 20 to form pixels.

Upon application of the voltage of 0 V to the control electrodes 4, no electric field is formed because there is no potential difference between the carrying roller 14 and the control electrodes 4, and the toner 16 carried on the carrying roller 14 does not pass through the apertures 6.

The recording medium 20 is delivered by one pixel in the direction perpendicular to the row of the apertures 6 in the course where pixels corresponding to one row of the apertures 6 are formed on its surface. This process is repeated to form a toner image on the whole surface of the recording medium 20. The toner image thus formed is thereafter fixed on the recording medium 20 by means of the fixing assembly 26.

The toner 16 having not passed through the apertures 6 and having remained on the carrying roller 14 is scraped off by the collecting roller 15 constituted of a brush roller. The toner 16 having adhered to the brush of the collecting roller 15 is further taken off by the collecting blade 21, and is again collected in the toner receptacle 21. The toner 16 collected in the toner receptacle 21 is mixed with a virgin toner 16 and agitated as the agitator is rotated, and part thereof is again used for the formation of images.

Next, using the above twelve samples of the toner 16, images were formed using the image-forming apparatus constituted as described above, and the images formed were evaluated using an image formed on the first sheet and an image formed on the 101st sheet after images were continuously printed on 100 sheets.

The recording medium 20 was delivered at a speed of 25 mm/sec. The rotational speeds of the various roller members rotatingly driven, provided in the toner feeding assembly 10, may slightly vary with changes in the thickness of the toner 16 formed by the toner layer control blade 18 and changes in the type of the toner, and hence they were appropriately controlled in accordance with such changes. When the peripheral speed of the carrying roller 14 greatly varies, the toner feed quantity per unit time may vary to greatly affect the density of the images formed. Accordingly, the peripheral speed of the carrying roller 14 was so controlled as to be maintained at 75 to 150 mm/second.

The results of the image evaluation made under the above conditions are shown in Table 2.

TABLE 2

| | Initial | | Running | |
|---|---|---|---|---|
| Toner | density | Initial fog | density | Running fog |
| A | 1.60 | 0.06 | 0.35 | 0.14 |
| B | 1.61 | 0.06 | 0.78 | 0.13 |
| C | 1.59 | 0.07 | 1.20 | 0.11 |
| D | 1.57 | 0.06 | 1.50 | 0.09 |
| E | 1.60 | 0.05 | 1.55 | 0.09 |
| F | 1.55 | 0.06 | 1.56 | 0.08 |
| G | 1.54 | 0.07 | 1.54 | 0.07 |
| H | 1.53 | 0.06 | 1.55 | 0.06 |
| I | 1.50 | 0.08 | 1.51 | 0.06 |

TABLE 2-continued

| | Initial | | Running | |
|---|---|---|---|---|
| Toner | density | Initial fog | density | Running fog |
| J | 1.37 | 0.06 | 1.32 | 0.07 |
| K | 1.28 | 0.09 | 1.28 | 0.09 |
| L | 0.98 | 0.08 | 0.88 | 0.10 |

The evaluation was made in the manner as described below. The image density was measured using a reflection densitometer RD814, manufactured by Macbeth Co., to measure density at areas where the voltage of +50 V or 0 V was applied to the control electrodes 4. The density at +50 V application at the on-time was measured as initial density and running density, and the density at 0 V application at the off-time as initial fog and running fog. The "initial" is meant to be first-sheet printing, and the "running", 101st-sheet printing.

In the case of the above measurement, it is necessary in practical use that the density at the on-time is 1.5 or above and the fog at the off-time is 0.10 or below.

As described above, in comparison with Toner A, to which no abrasive is used, Toners B to L, to which the abrasive is used, can be restrained from thermally melt-adhering by the aid of the abrasive to bring about an improvement in running performance. However, the use of the abrasive in a too large quantity causes an insufficient initial density and a little running fog. This is because the quantity of the abrasive affects the charge quantity of toner. Accordingly, so long as the abrasive is used in an appropriate quantity as in the case of Toners D to I, a good contrast can be attained in initial images, and also the thermal melt-adhesion can be prevented to bring about an improvement in running performance. This appropriate quantity of the abrasive is in the range of from 0.01 to 3 parts by weight. In particular, Toner H, in which the abrasive is used in an amount of 1 part by weight, makes it possible to form the best images.

Figure 5A:
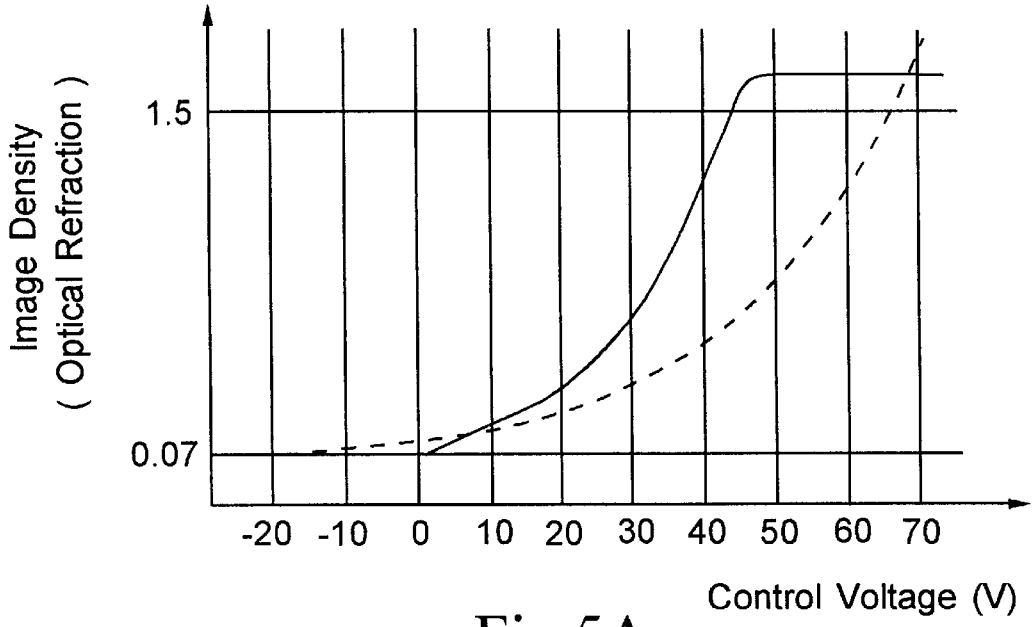
FIGS. 5A and 5B are graphs showing control voltage characteristics in relation to image density in the above image-forming apparatus.
Figure 5B:
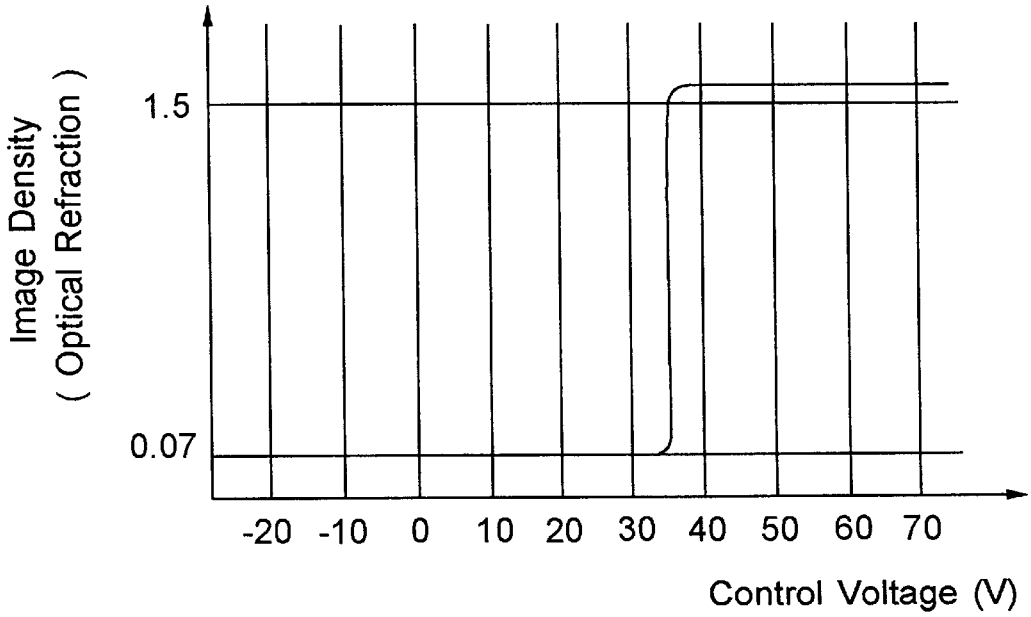

In the case of this Toner H, the toner is fed to the apertures 6 in a uniform charge quantity, and hence, as shown by the solid line in FIG. 5A, the necessary and sufficient contrast is attained at the drive voltage of 50 V.

In the image-forming apparatus constituted as described previously, in order to impart uniform and saturated charging to the toner 16, a very strong stress must be applied to the toner 16 between the aperture electrode member 1 and the carrying roller 14. However, when the present embodiment is employed, the presence of the abrasive in an appropriate quantity enables removal of fragments or molten pieces of the toner 16 broken by that stress and being about to adhere to the aperture electrode member 1. Hence, the toner 16 can be always stably fed to the apertures 6, and it becomes possible to form good images over a long period of time. Thus, the image-forming apparatus constituted as described previously and employing the toner according to the present embodiment makes it possible to promise a very superior running performance and to form images having a good contrast.

In the process of producing the toner constituted as described above, a cross-linking agent may be added at the time of kneading, whereby the high-molecular weight region of the binder resin component of the toner can be increased and also the durability to the stress can be improved.

In the image-forming apparatus described above, the respective constituents are disposed in such a manner that the toner 16 can readily flow back through the course formed in the order of from the agitator 17, the toner layer control blade 18, the carrying roller 14 and the collecting roller 15 and also that any greatly concave portions are not present in structure so that the toner 16 may hardly stagnate. Hence, the toner 16 may less deteriorate.

In addition, when an insulating toner is used in the above image-forming apparatus, insulation is maintained between the carrying roller 14 and the control electrodes 4 and between the individual control electrodes 4, so that the aperture electrode member 1 can be free from being broken by short circuit between the both. Since the insulating sheet of the aperture electrode member 1 is set to face the carrying roller 14 side, the control electrodes 4 and the surface of the carrying roller 14 can be free from electrical short and hence the circuit elements of the control voltage application circuits 8 can be free from being broken, even when the toner 16 is not present on the carrying roller 14 because of any trouble of the toner feeding assembly 10.

Since also the aperture electrode member 1 and the toner 16 carried on the carrying roller 14 are in contact with each other at the entrance of the apertures 6, the toner 16 accumulating at the entrance of the apertures 6 is carried away by the toner 16 successively fed by the carrying roller 14, and hence the toner 16 does not stop up the apertures 6.

The present invention is by no means limited to the embodiment described above in detail, and can be variously modified within the scope not deviating from the purport of the present invention.

For example, in the toner according to the above embodiment, an example is shown in which aluminum oxide is used as the abrasive. The same effect can also be obtained when titanium oxide is used. Also, aluminum oxide and titanium oxide may be used in the form of a mixture without any difficulty.

In the image-forming apparatus according to the embodiment described above, the aperture electrode member is used as the toner flow control means. It is also possible to use, e.g., a network electrode member as disclosed in U.S. Pat. No. 5,036,341.

In the image-forming apparatus according to the embodiment described above, the brush type collecting roller is used as a means for collecting the toner remaining on the carrying roller 14. Without limitation thereto, a strongly adhesive silicone rubber or the like may be used. Alternatively, the remaining toner may be taken off using a blade made of urethane resin or the like.

The entire disclosure of Japanese Patent Application No. 08-251261 filed on Sep. 24, 1996 including the specification, claims, figures and summary is herein incorporated by reference in its entirety.

What is claimed is:

1. A toner for use in an image-forming apparatus which has an aperture electrode member for controlling the flow of a charged toner and a toner feeding means for feeding the charged toner to the aperture electrode member, where the aperture electrode member comprises an insulating sheet, a plurality of apertures formed at a specified position through the insulating sheet and a control electrode formed on the insulating sheet for each aperture, and the toner feeding means and the aperture electrode member are arranged such that a surface of the toner is in contact with the toner feeding means and an opposing surface of the toner is in contact with the aperture electrode member at the specified position where the toner is supplied through the plurality of apertures and so as to allow the charged toner to fly from the toner feeding means toward a recording medium by applying a voltage to the control electrode while passing through the aperture, said toner comprising:

a core material that includes a binder resin; and a fine-powdered abrasive adhered to the surface of the core material, so as to facilitate passage of the toner through the apertures of the aperture electrode member.

2. The toner according to claim 1, wherein said abrasive is aluminum oxide or titanium oxide.

3. The toner according to claim 1, wherein said abrasive is used in an amount of from about 0.01 part by weight to about 3 parts by weight based on 100 parts by weight of the binder resin.

4. The toner according to claim 3, wherein said abrasive is used in an amount of from about 0.1 part by weight to about 1 parts by weight based on 100 parts by weight of the binder resin.

5. The toner according to claim 1, wherein said abrasive has a particle diameter of from 0.0001 to 1 $\mu$m.

6. The toner according to claim 5, wherein said abrasive has a particle diameter of from 0.001 to 0.1 $\mu$m.

7. The toner according to claim 1, wherein said core material is at least one of the group consisting of a styrene-acrylic resin, a polyester resin, a melamine resin, a phenol resin and a nylon resin.

8. The toner according to claim 1, wherein said core material has a particle diameter of from 5 to 20 $\mu$m.

9. The toner according to claim 8, wherein said core material has a particle diameter of from 6 to 12 $\mu$m.

10. An image forming apparatus, comprising:

an aperture electrode member for controlling the flow of a charged toner, the aperture electrode member including an insulating sheet, a plurality of apertures formed at a specified position through the insulating sheet and a control electrode formed on the insulating sheet for each aperture;

toner feeding means for feeding the charged toner to the aperture electrode member, the toner feeding means and the aperture electrode member being arranged such that a surface of the toner is in contact with the toner feeding means and an opposing surface of the toner is in contact with the aperture electrode member at the specified position where the toner is supplied through the plurality of apertures and so as to allow the charged toner to fly from the toner feeding means toward a recording medium by applying a voltage to the control electrode while passing through the aperture; and toner, the toner including a core material that includes a binder resin, and a fine-powdered abrasive adhered to the surface of the core material, so as to facilitate passage of the toner through the apertures of the aperture electrode member.

* * * * *